US009770752B2

(12) United States Patent
Fukushima et al.

(10) Patent No.: US 9,770,752 B2
(45) Date of Patent: Sep. 26, 2017

(54) MANUFACTURING METHOD OF GEARS FOR A SPEED CHANGE DEVICE AND ITS APPARATUS

(71) Applicant: GOHSYU CORPORATION, Shiga (JP)

(72) Inventors: Mikio Fukushima, Shiga (JP); Kenji Tasaki, Shiga (JP); Makoto Tanaka, Shiga (JP)

(73) Assignee: GOHSYU CORPORATION, Shiga (JP)

( * ) Notice: Subject to any disclaimer, the term of this patent is extended or adjusted under 35 U.S.C. 154(b) by 169 days.

(21) Appl. No.: 14/524,302

(22) Filed: Oct. 27, 2014

(65) Prior Publication Data

US 2015/0128420 A1 May 14, 2015

(30) Foreign Application Priority Data

Nov. 8, 2013 (JP) ..... 2013-232402

(51) Int. Cl.
*B21D 15/02* (2006.01)
*B21K 1/30* (2006.01)

(52) U.S. Cl.
CPC ..... *B21K 1/30* (2013.01); *B21D 15/02* (2013.01); *Y10T 29/49474* (2015.01)

(58) Field of Classification Search
CPC ..... B21K 1/30; B21D 15/02
USPC ..... 72/452.1, 452.8, 452.9, 402
See application file for complete search history.

(56) References Cited

U.S. PATENT DOCUMENTS

| | | | | |
|---|---|---|---|---|
| 4,470,290 A * | 9/1984 | Jungesjo | ..... | B21D 15/02 29/893.34 |
| 5,946,963 A * | 9/1999 | Suzuki | ..... | B21K 1/30 29/893.34 |
| 2008/0104843 A1* | 5/2008 | Matsushita | ..... | B21K 1/30 29/893.33 |

FOREIGN PATENT DOCUMENTS

| | | |
|---|---|---|
| JP | 8-47743 | * 2/1996 |
| JP | 8-187539 | 7/1996 |
| JP | 11-294481 | * 10/1999 |
| JP | 2009-101366 | * 5/2009 |
| JP | 2009-262173 | * 11/2009 |
| JP | 2013141682 | * 7/2013 |

* cited by examiner

*Primary Examiner* — David B Jones
(74) *Attorney, Agent, or Firm* — Wenderoth, Lind & Ponack, L.L.P.

(57) ABSTRACT

A manufacturing method and apparatus for gears for a speed change device. The gears having a large end and a small end forming a reverse-tapered tooth part on an outer circumference thereof, spline teeth of an intermediate material having the small end provided in a rim of the large end thereof, a plurality of dies having a radial shape and an inclination angle to a gear axial line and slidably holding to an inclined axial line on a holding member are slid from outside of the radiation direction toward the center by a pushing cam mechanism, thereby pushing the reverse-tapered blade part formed at the leading end of the die, the spline teeth are formed in the reverse-tapered tooth part, and the die is slid by an extracting mechanism from the center of the radiation direction toward the outside along the inclined axial line.

3 Claims, 3 Drawing Sheets

MANUFACTURING METHOD OF GEARS FOR A SPEED CHANGE DEVICE AND ITS APPARATUS

TECHNICAL FIELD

The present invention relates to a manufacturing method of gears for a speed change device and its apparatus, and more particularly to a manufacturing method of gears for a speed change device having a large end and a small end forming teeth with a reverse taper on an outer circumference thereof, and having the small end provided in a rim of the large end and its apparatus.

BACKGROUND ART

Conventionally, as shown in FIG. 3 (*a*), comprising a large end 11 and a small end 12 used in a synchro-mesh mechanism, a reverse-tapered tooth part 12*a* is formed on the outer circumference of the small end 12 to compose a gear 1A for a speed change device, separate large-end gear and small-end gear are integrated by electron beam welding or spline fitting means, and an integral structure is formed by forging or the like (see, for example, patent document 1).

In particular, the gears integrated by electron beam welding require an assembling process, and adverse effects due to welding strain may be considered, or in the case of the gears integrated by spline fitting means, an assembling process is needed, and splines must be formed, and the spline forming process is complicated, and generally the gears are integrally formed by forging.

On the other hand, from the viewpoint of downsizing and compact design of an automobile, as shown in FIGS. 3 (*b*) and (*c*), for reduction of thickness, a small end 12 forming a reverse-tapered gear part on the outer circumference is provided in a rim 11*a* of a large end, and gears 1B, 1C for a speed change device of so-called sink type are widely employed.

Incidentally, since the reverse-tapered tooth part 12*a* is formed by a die which projects horizontally from the outside of the radiation direction toward the center, out of such sink type gears 1B, 1C, as shown in FIG. 3 (*b*), in the case of the gear 1B smaller in the degree of sink, and larger in the groove width of an annular groove 11*b* formed between the reverse-tapered tooth part 12*a* and the rim 11*a*, by using a hook-shaped die bent so as to avoid the rim 11*a*, it is possible to form integrally by forging, but as shown in FIG. 3 (*c*), in the case of the gear 1C smaller in the groove width of an annular groove 11*b* formed between the reverse-tapered tooth part 12*a* and the rim 11*a*, and larger in the degree of sink in order to reduce the thickness, it was impossible to form by forging.

To solve this problem, a new manufacturing method of gears for a speed change device is proposed, in which a large end and a small end are overlapped in a stepped doughnut shape, a reverse-tapered tooth part is formed on the outer circumference of the small end to manufacture a primary formed part, and a range excluding the small end including the reverse-tapered tooth part, and the rim forming portion at the large end continuous to the small end is confined, and the peripheral wall thickness at the large end is extruded to the small end side, and by this extruded wall thickness portion, a rim surrounding the small end concentrically is formed (see, for example, patent document 2), but since a large load is generated when extruding the peripheral wall thickness at the large end toward the small end side, the manufacturing apparatus becomes larger in size, and deformation of gears is deviated locally, and strains are likely to occur in the gears.

PRIOR ART DOCUMENTS

Patent Documents

[Patent document 1] Japanese Patent Application Laid-Open No. 52-61162

[Patent document 2] Japanese Patent Application Laid-Open No. 2002-113543

SUMMARY OF THE INVENTION

Problems to be Solved by the Invention

The present invention is devised in the light of solving the problems of the manufacturing method of gears for a speed change device discussed above, and it is hence a primary object thereof to present a manufacturing method of gears for a speed change device and its apparatus capable of manufacturing gears for a speed change device by using a manufacturing apparatus small in load when forming, and small and simple in structure, and capable of obtaining gears for a speed change device not localized in gear deformation positions, small in generation of strain due to fluidization of metal texture, and large in strength.

Means for Solving the Problems

To achieve the object, the manufacturing method of gears for a speed change device of the invention relates to a manufacturing method of gears for a speed change device having a large end and a small end forming a reverse-tapered tooth part on an outer circumference thereof, and having the small end provided in a rim of the large end, in which the small end has spline teeth parallel to the gear axial line provided in the large end and the outer circumference, and a plurality of dies slidably held along an inclined axial line in a holding member having a radial shape and an inclination angle to the gear axial line are, to the spline teeth of an intermediate material with the small end provided in the large end, slid from the outside of the radiation direction toward the center along the inclined axial line by a pushing cam mechanism, thereby pushing in a reverse-tapered blade part formed at the leading end of the dies, and spline teeth are formed in the reverse-tapered tooth part, and the dies are slid from the center of the radiation direction toward the outside along the inclined axial line by an extracting mechanism.

The manufacturing apparatus of gears for a speed change device of the invention is a manufacturing apparatus of gears for a speed change device having a large end and a small end forming a reverse-tapered tooth part on an outer circumference thereof, and having the small end provided in a rim of the large end, including a die forming a reverse-tapered blade part at a leading end, a holding member for holding a plurality of the dies slidably along an inclined axial line having a radial shape and an inclination angle to the gear axial line, a pushing cam mechanism having a small end forming spline teeth in the large end and the outer circumference parallel to the gear axial line, for pushing the reverse-tapered blade part formed at a leading end of the dies, by sliding the small end to the spline teeth of an intermediate material provided in the rim of the large end, thereby forming the spline teeth in the reverse-tapered tooth part, and an extracting mechanism for sliding the dies from the center of the radiation direction toward the outside along the inclined axial line.

In this case, a provisional holding mechanism may be provided, that is, the intermediate material is provisionally held so as to be rotatable on the gear axial line, so that the spline teeth of the intermediate material and the reverse-tapered blade part formed at the leading end of the dies can be positioned.

Effects of the Invention

According to the manufacturing method of gears for a speed change device and its apparatus of the invention, having a large end and a small end forming a reverse-tapered tooth part on an outer circumference thereof, to spline teeth of an intermediate material having the small end provided in a rim of the large end, a plurality of dies slidably held along an inclined axial line in a holding member having a radial shape and an inclination angle to the gear axial line are slid from the outside of the radiation direction toward the center along the inclined axial line by a pushing cam mechanism, thereby pushing in a reverse-tapered blade part formed at the leading end of the dies, and spline teeth are formed in the reverse-tapered tooth part, and the dies are slid from the center of the radiation direction toward the outside along the inclined axial line by an extracting mechanism, and therefore by using a manufacturing apparatus (press apparatus) small in the load when forming, small in size, and small and simple in structure, the gears for a speed change device can be manufactured, and the gear deformation positions are not limited locally, generation of strain is small, and the gears for a speed change device large in strength can be obtained.

In addition, by employing a provisional holding mechanism for positioning the spline teeth of an intermediate material and the reverse-tapered blade part formed at a leading end of the dies, by holding the gear axial line provisionally so as to be rotatable on the center, the spline teeth of an intermediate material and the reverse-tapered blade part formed at a leading end of the dies can be positioned easily.

BRIEF DESCRIPTION OF THE DRAWINGS

FIGS. 2(A)-2(D) are explanatory diagrams showing gears for a speed change device manufactured by a manufacturing method of gears for a speed change device of the invention, in which FIG. 2(A) is a sectional view of gears for a speed change device, FIG. 2(B) is its bottom view, FIG. 2(C) is a magnified view of a reverse-tapered tooth part of the gears for a speed change device, and FIG. 2(D) is a magnified view of spline teeth of an intermediate material.

BEST MODE FOR CARRYING OUT THE INVENTION

Embodiments of a manufacturing method of gears for a speed change device and its apparatus of the invention are specifically described below by referring to the accompanying drawings.

Figure 1:
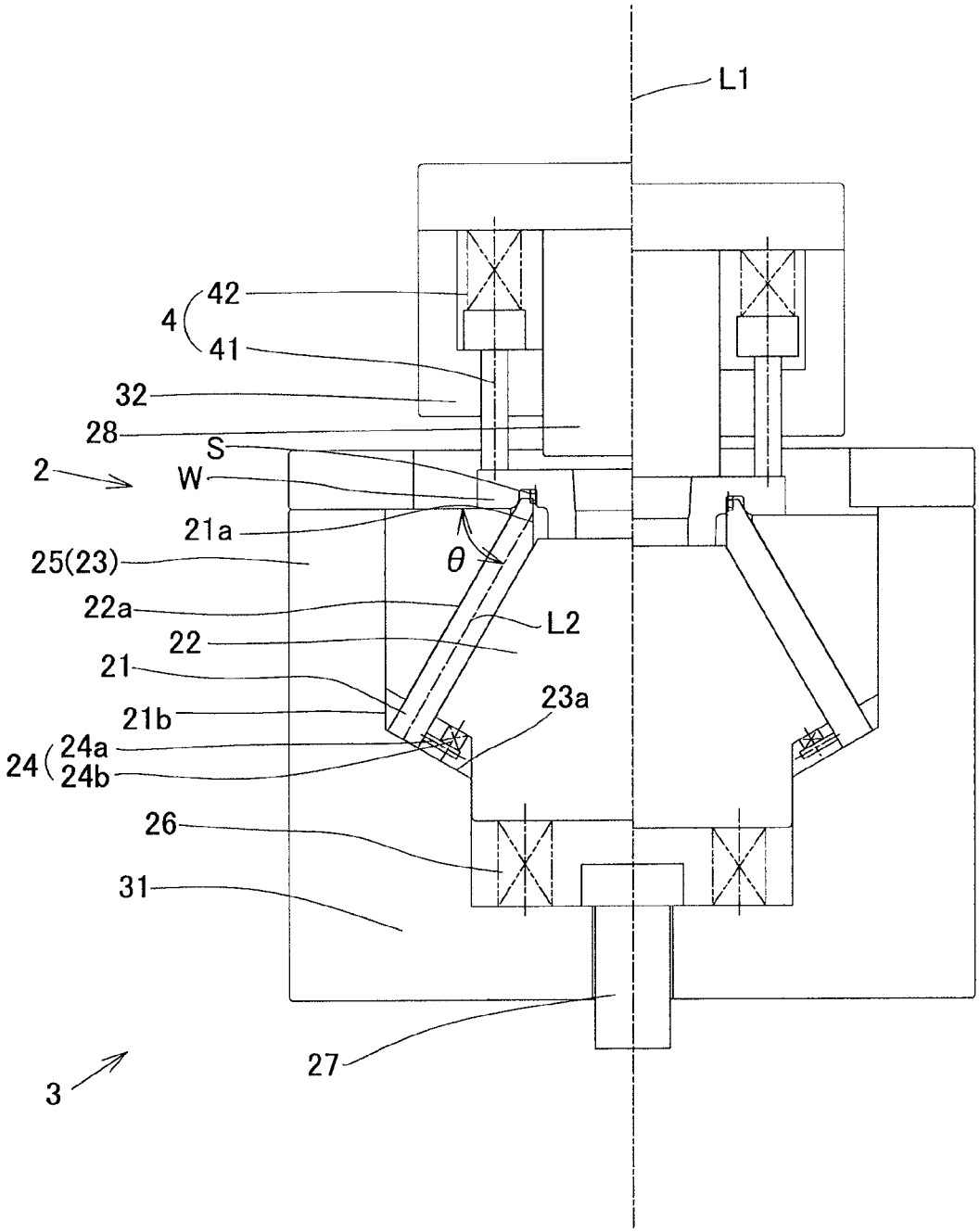
FIG. 1 is an explanatory diagram showing an embodiment of a manufacturing apparatus of gears for a speed change device of the invention.
Figure 2C:
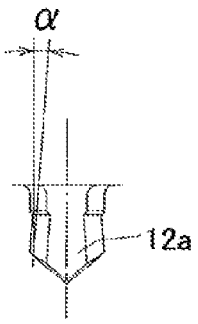
Figure 2A:
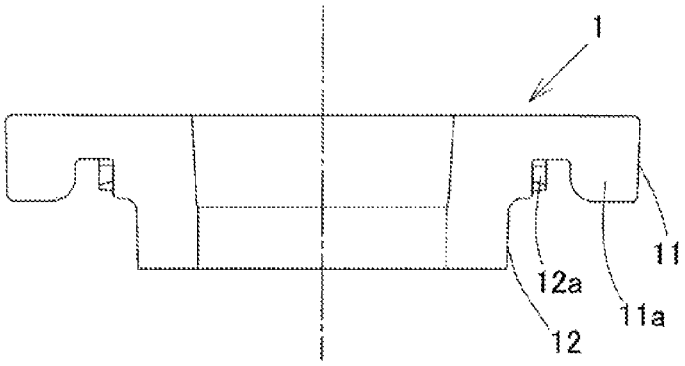
Figure 2D:
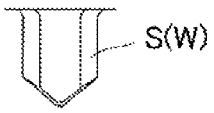
Figure 2B:
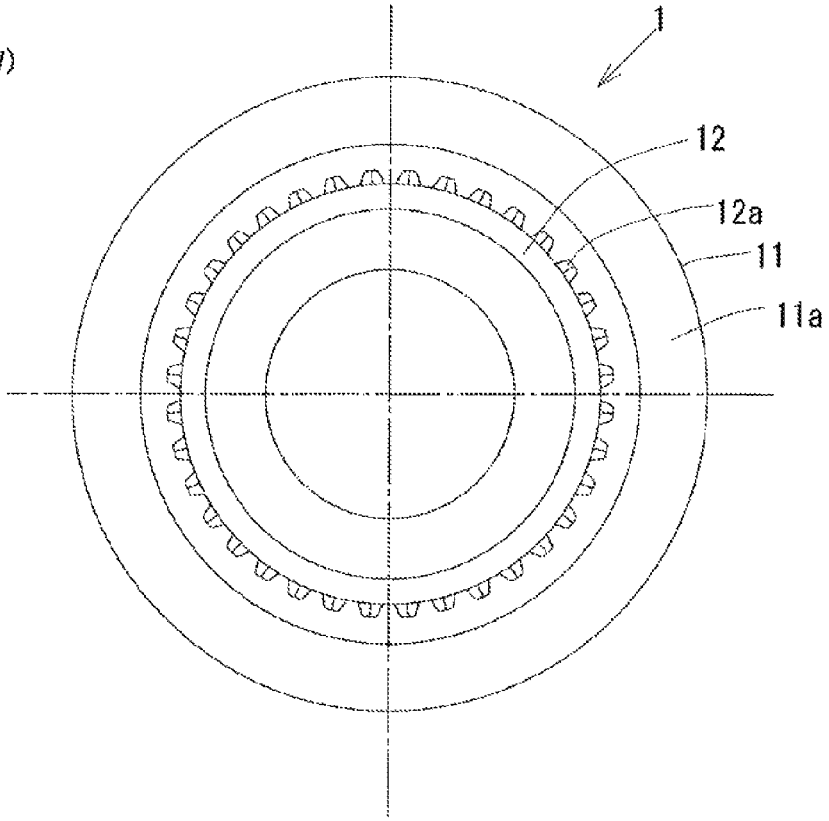

FIG. 1 shows an embodiment of a manufacturing apparatus of gears for a speed change device of the invention.

Figure 3A:
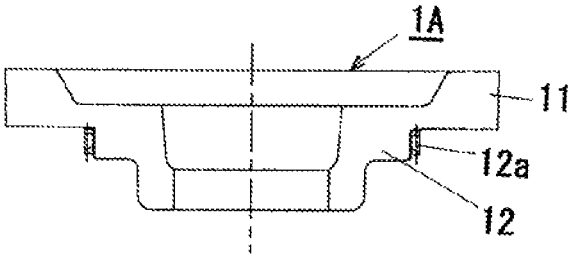
FIGS. 3(A)-3(C) are explanatory diagrams showing various gears for a speed change device.
Figure 3B:
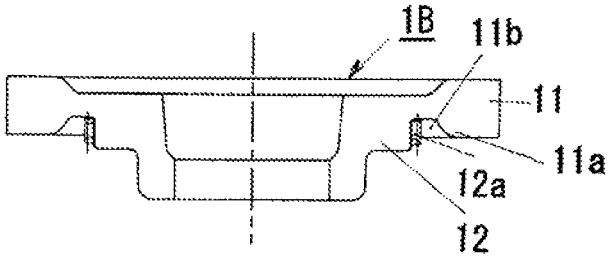
Figure 3C:
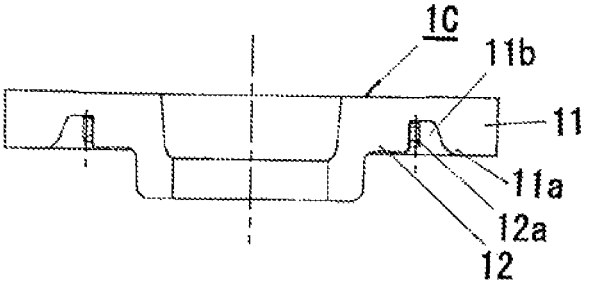

This manufacturing apparatus 2 of gears for a speed change device includes, as shown in FIG. 2, a large end 11 and a small end 12 forming a reverse-tapered tooth part 12*a* on an outer circumference thereof, and is designed to manufacture gears 1 for a speed change device having the small end 12 provided in a rim 11*a* of the large end 11, and in particular it is preferably used for manufacture of the gears 1 for a speed change device (gears 1C for a speed change device shown in FIG. 3 (*c*)) small in the groove width of an annular groove 11*b* formed between the reverse-tapered tooth part 12*a* (reverse taper angle a: approx. 3° to 5°) and the rim 11*a*, and large in groove depth (degree of sinking) for the sake of reduction of thickness.

The manufacturing apparatus 2 of gears for a speed change device includes a die 21 forming a reverse-tapered blade part 21*a* at a leading end, a plurality of (usually same as the number of grooves formed in the reverse-tapered tooth part 12*a* formed in the small end 12) holding members 22 having a radial shape and an inclination angle θ to a gear axial line L1 for holding slidably to an inclined axial line L2, a large end and a small end forming spline teeth S parallel to the gear axial line on an outer circumference, and also includes a pushing cam mechanism 23 for sliding the die 21 from the outside of the radiation direction toward the center along the inclined axial line L2, to the spline teeth S of the intermediate material W having this small end provided in the rim of the large end, and thereby pushing the reverse-tapered blade part 21*a* formed at the leading end of the die 21, and forming the spline teeth S in the reverse-tapered tooth part 12*a*, and an extracting mechanism 24 for sliding the die 21 from the center of the radiation direction toward the outside along the inclined axial line L2.

In this case, the die 21 forming the reverse-tapered blade part 21*a* at the leading end is shaped like a bar, and is held by the holding member 22 so as to contact between a rear end face 21*b* and an inclined cam face 23*a* of the pushing cam mechanism 23.

The holding member 22 has a plurality of dies 21 (usually same as the number of grooves formed in the reverse-tapered tooth part 12*a* formed in the small end 12) provided in holding holes 22*a* having a radial shape and an inclination angle θ to a gear axial line L1 for holding slidably to an inclined axial line L2, and is designed to be divided along the holding holes 22*a*.

This holding member 22 is installed movably in a tubular guide member 25 in the vertical direction, with the die 21 held in the holding holes 22*a*, and is supported on a lower platform 31 of a press device 3, by way of an elastic support mechanism 26 made of a spring member (or a hydraulic mechanism), and is pressed by a punch 28 provided in an upper platform 32 of the press device 3 through an intermediate material W, and is moved downward by resisting the thrusting force of the elastic support mechanism 26.

Incidentally, the size of the inclination angle θ (the inclination angle of the inclined axial line L2 to the horizontal plane) is determined by the shape of the gear 1 for a speed change device, but specifically it is determined by various factors such as the size of the gear 1 for a speed change device, the groove width and groove depth of the annular groove 11*b* formed between the reverse-tapered tooth part 12*a* and the rim 11*a* (including the degree of sinking), and the tooth length of the reverse-tapered tooth part 12*a*, but as the size of the gear 1 for a speed change device becomes smaller, or as the groove width of the annular groove 11*b* formed between the reverse-tapered tooth part 12*a* and the rim 11*a* becomes narrower, or as the groove depth (the degree of sinking) becomes deeper, or as the tooth length of the reverse-tapered tooth part 12*a* becomes longer, the inclination angle θ must be set larger.

However, as the inclination angle θ becomes larger, a greater pressing force of the press device 3 is needed for forming the spline teeth S of the intermediate material W in the reverse-tapered tooth part 12*a*, and at the same time it is required to increase the strength of the materials of the die 21, holding member 22, the guide member 25, and others.

Accordingly, it is preferable to set the inclination angle θ as small as possible depending on the shape of the gear 1 for a speed change device, and it is more preferable to set at 70° or less at most (60° in this embodiment). Meanwhile, the minimum value of the inclination angle θ is not particularly specified, but if the inclination angle θ is less than 15°, the gear 1 for a speed change device in an applicable shape can be usually manufactured by employing a conventional manufacturing method.

The pushing cam mechanism 23 pushes the holding member 22 to move downward by a punch 28 of the press device 3 by way of the intermediate material W, the die 21 is slid from the outside of the radiation direction toward the center along the inclined axial line L2, with respect to the spline teeth S of the intermediate material W, and the reverse-tapered blade part 21*a* formed at the leading end of the die 21 is pushed in, thereby forming the spline teeth S in the reverse-tapered tooth part 12*a*, and therefore, in the embodiment, the inner circumference of a lower part of a guide member 25 installed in a vertical movable direction of the holding member 22 is composed by forming in an inclined cam face 23*a* of a shape reducing in diameter downward, contacting with a rear end face 21*b* off the die 21.

The extracting mechanism 24 is for sliding the die 21 from the center of the radiation direction toward the outside along the inclined axial line L2 after forming the spline teeth S in the reverse-tapered tooth part 12*a* by the moving cam mechanism 23, and therefore, in the embodiment, it is composed of a knock pin 24*a* planted in a rear part of the die 21, and a spring member 24*b* for thrusting this knock pin 24*a* from the center of the radiation direction toward the outside.

The side of the lower platform 31 of the press device 3 is provided with a knock-out pin 27 for pushing up the holding member 22 after forming the spline teeth S in the reverse-tapered tooth part 12*a* by the pushing cam mechanism 23.

The side of the upper platform 32 of the press device 3 is provided with a provisional holding mechanism 4 for positioning between the spline teeth S of the intermediate material W and the reverse-tapered blade part 21*a* formed at the leading end of the die 21, by provisionally holding the intermediate material W so as to be rotatable about the gear axial line L1.

This provisional holding mechanism 4 is composed of a plurality of thin bar-shaped punches 41 disposed at equal angular intervals on the outer circumferential side of the punch 28, and a spring member 42.

Accordingly, prior to fixing of the intermediate material W between the punch 28 and the holding member 22, the intermediate material W provisionally held so as to be rotatable about the gear axial line L1 against the holding member 22 by the provisional holding member 4 is automatically rotated by positioning with the reverse-tapered blade part 21*a* formed at the leading end of the die 21, so that positioning may be easily achieved between the spline teeth S of the intermediate material W and the reverse-tapered blade part 21*a* formed at the leading end of the die 21.

Next is explained the manufacturing method of the gear 1 for a speed change device by employing this manufacturing apparatus 2 of gears for a speed change device.

First of all, comprising a large end and a small end forming spline teeth parallel to the axial line on its outer circumference, an intermediate material W forming the small end in a rim of the large end is prepared, and this intermediate material W is installed in the holding member 22 of the manufacturing apparatus 2 of gears for a speed change device, with the small end forming the spline teeth S set downward.

In this state, by operating the press device 3, when the upper platform 32 side is lowered, the intermediate material W is, prior to being fixed between the punch 28 and the holding member 22, provisionally held so as to be rotatable about the center of the gear axial line L1 against the holding member 22 by the provisional holding mechanism 4, and is rotated automatically as being positioned with the reverse-tapered blade part 21*a* formed at the leading end of the die 21, so that the spline teeth S of the intermediate material W is positioned with the reverse-tapered blade part 21*a* formed at the leading end of the die 21.

Further, when the upper platform 32 side is lowered to the spline teeth S of the intermediate material W, the intermediate material W is fixed between the punch 28 and the holding member 22, and the holding member 22 is pressed by the punch 28 of the press device 3 by way of the intermediate material W and is moved downward, and therefore the plurality of dies 21 held by the pushing cam mechanism 23 so as to be slidable along the inclined axial line L2 to the holding member 22 having a radial shape and an inclination angle θ to the gear axial line L1 are slid from the outside of the radiation direction toward the center along the inclined axial line L2, and thereby the reverse-tapered blade part 21*a* formed at the leading end of the die 21 is pushed into the gap of the spline teeth S, so that the spline teeth S are formed in the reverse-tapered tooth part 12*a*.

In this manner, after the spline teeth S are formed in the reverse-tapered tooth part 12*a*, the upper platform 32 side is moved upward, and the holding member 22 is pushed up by the action of the elastic support mechanism 26 and the knock-out pin 27, and at the same time, by the extracting mechanism 24, the dies 21 are slid from the center of the radiation direction toward the outside along the inclined axial line L2, and the reverse-tapered blade part 21*a* extracts the dies 21 pushed into the gap of the spline teeth S.

As a result, the gear 1 for a speed change device can be manufactured by using the manufacturing apparatus 2 (press device 3) of small load in forming and small and simple structure, which makes it possible to obtain the gear 1 for a speed change device not limited in gear deformation positions, small in generation of strain, and large in strength.

Herein, the manufacturing method of gears for a speed change device and its apparatus of the invention are described on the basis of its embodiment, but it must be noted that the invention is not limited to the illustrated embodiment alone, but may be changed and modified in the structure within a scope not departing from its true spirit.

INDUSTRIAL APPLICABILITY

The manufacturing method of gears for a speed change device and its apparatus of the invention are capable of manufacturing gears for a speed change device small in load when forming, and small and simple in structure, thereby obtaining gears for a speed change device not limited in the gear deformation positions, small in generation of strain due to fluidization of metal texture, and large in strength, and therefore as shown in FIG. 2, it is intended to manufacture gears for a speed change device comprising a large end 11 and a small end 12 forming a reverse-tapered tooth part 12*a* on its outer circumference, and having the small end 12 provided in a rim 11*a* of the large end 11, and in particular, it is preferable for manufacturing the gear 1 for a speed change device (the gear 1C for a speed change device shown in FIG. 3 (*c*)) small in the groove width of an annular groove 11*b* formed between the reverse-tapered tooth part 12*a* and the rim 11*a*, and large in the groove depth (the degree of sinking) for reduction of wall thickness.

DESCRIPTION OF THE REFERENCE NUMERALS

1 gear for a speed change device
11 large end
11*a* rim
12 small end
12*a* reverse-tapered tooth part
2 manufacturing apparatus of gears for a speed change device
21 die
21*a* reverse-tapered blade part
22 holding member
23 pushing cam device
24 extracting mechanism
25 guide member
26 elastic supporting mechanism
27 knock-out pin
28 punch
3 press device
31 lower platform
32 upper platform
4 provisional holding mechanism
L1 gear axial line
L2 inclined axial line
θ Inclination angle
W intermediate material
S spline teeth

The invention claimed is:

1. A manufacturing method of gears for a speed change device, the manufacturing method comprising:

using a manufacturing apparatus to form a respective gear of the gears, the respective gear of the gears having a large end and a small end including a reverse-tapered tooth part on an outer circumference of the small end, and the small end being provided in a rim of the large end, the manufacturing apparatus comprising:

a die including a reverse-tapered blade part at a leading end of the die;

a holding member having a radial shape;

a pushing cam mechanism;

an extracting mechanism; and a guide member;

holding, via the holding member, a plurality of the die slidably along an inclined axial line and an inclination angle to a gear axial line;

pushing, via the pushing cam mechanism, the reverse-tapered blade part at the leading end of the die into an intermediate material, the intermediate material used to form the respective gear and having a small end and a large end, the small end of the intermediate material including spline teeth on an outer circumference of the small end of the intermediate material parallel to the gear axial line, the small end of the intermediate material provided in a rim of the large end of the intermediate material, the pushing cam mechanism pushing the reverse-tapered blade part at the leading end of the die by sliding the die to the spline teeth of the intermediate material, thereby forming spline teeth of the reverse-tapered tooth part; and sliding, via the extracting mechanism, the die from a center of a radiation direction outwardly along the inclined axial line, wherein an inner circumference of a lower part of the guide member includes an inclined cam face that is shaped so as to reduce in diameter downwardly, the inclined cam face contacting with a rear end face of the die, and the guide member and the inclined cam face being fixed, and the extracting mechanism includes a knock pin planted in a rear part of the die, and a spring member for thrusting the knock pin outwardly from the center of the radiation direction.

2. A manufacturing apparatus of gears for a speed change device, a respective gear of the gears having a large end and a small end including a reverse-tapered tooth part on an outer circumference of the small end, and the small end being provided in a rim of the large end, the manufacturing apparatus comprising:

a die including a reverse-tapered blade part at a leading end of the die;

a holding member for holding a plurality of the die slidably along an inclined axial line and an inclination angle to a gear axial line, the holding member having a radial shape;

a pushing cam mechanism for pushing the reverse-tapered blade part at the leading end of the die into an intermediate material, the intermediate material used to form the respective gear and having a small end and a large end, the small end of the intermediate material including spline teeth on an outer circumference of the small end of the intermediate material parallel to the gear axial line, the small end of the intermediate material provided in a rim of the large end of the intermediate material, the pushing cam mechanism pushing the reverse-tapered blade part at the leading end of the die by sliding the die to the spline teeth of the intermediate material, thereby forming spline teeth of the reverse-tapered tooth part;

an extracting mechanism for sliding the die from a center of a radiation direction outwardly along the inclined axial line; and a guide member, wherein an inner circumference of a lower part of the guide member includes an inclined cam face that is shaped so as to reduce in diameter downwardly, the inclined cam face contacting with a rear end face of the die, and the guide member and the inclined cam face being fixed, and the extracting mechanism includes a knock pin planted in a rear part of the die, and a spring member for thrusting the knock pin outwardly from the center of the radiation direction.

3. The manufacturing apparatus of gears for a speed change device according to claim 2, further comprising:

a punch; and a provisional holding mechanism for positioning between the spline teeth of the intermediate material and the reverse-tapered blade part at the leading end of the die, by provisionally holding the intermediate material so as to be rotatable about a center of the gear axial line, wherein the provisional holding mechanism includes a plurality of thin bar-shaped punches disposed at equal angular intervals on an outer circumferential side of the punch, and a spring member.

* * * * *